US006463908B1

(12) United States Patent
Gibson et al.

(10) Patent No.: US 6,463,908 B1
(45) Date of Patent: Oct. 15, 2002

(54) GRAVITY AND/OR THERMAL CONTRACTION REPLENISHING RESERVOIR FOR ENGINE HYDRAULIC SYSTEM

(75) Inventors: Dennis H. Gibson, Chillicothe; Jerry A. Wear, East Peoria, both of IL (US)

(73) Assignee: Caterpillar Inc, Peoria, IL (US)

( * ) Notice: Subject to any disclaimer, the term of this patent is extended or adjusted under 35 U.S.C. 154(b) by 3 days.

(21) Appl. No.: 09/710,139

(22) Filed: Nov. 10, 2000

(51) Int. Cl.[7] ..... F02M 7/00
(52) U.S. Cl. ..... 123/447; 123/196 M
(58) Field of Search ..... 123/447, 456, 123/446, 179.9, 179.15, 179.17, 196 M, 196 R

(56) References Cited

U.S. PATENT DOCUMENTS 5,168,855 A * 12/1992 Stone ..... 123/446
5,213,083 A 5/1993 Glassey
5,245,970 A 9/1993 Iwaszkiewicz et al.
5,787,863 A 8/1998 Henig et al.
5,839,413 A 11/1998 Krause et al.
5,913,293 A * 6/1999 Ochiai ..... 123/90.33

* cited by examiner

*Primary Examiner*—Willis R. Wolfe
*Assistant Examiner*—Mahmoud Gimie
(74) *Attorney, Agent, or Firm*—Liell & McNeil

(57) ABSTRACT

In one case of hydraulically actuated fuel injection systems, the engine lubricating oil is utilized as the hydraulic medium to actuate the individual fuel injectors. In a typical example, these fuel injectors are fluidly connected to a common rail that is maintained a relatively high pressure when the engine is running. When the engine is turned off, the oil in the common rail both drops in pressure and in temperature. As this occurs, a thermal contraction effect takes place. This lost volume is made up by an oil replenishing reservoir that captures some of the engine lubricating oil that finds its way into the chamber defined by the engine head and valve cover. A check valve is positioned between the oil replenishing reservoir and the common rail so that the two are isolated from one another while the engine is running. At free start, shorter engine cranking times are encountered because the hydraulically actuated fuel injection system can come up to full pressure substantially faster.

20 Claims, 3 Drawing Sheets

GRAVITY AND/OR THERMAL CONTRACTION REPLENISHING RESERVOIR FOR ENGINE HYDRAULIC SYSTEM

TECHNICAL FIELD

This invention relates generally to hydraulic systems for engines, and more particularly to a device and method for replenishing fluid loses in a common rail for an engine hydraulic system.

BACKGROUND ART

An example of a typical hydraulic system for an engine might be a set of hydraulically actuated fuel injectors that utilize engine lubricating oil as their actuation fluid medium. It has long been known that engine lubricating oil expands and contracts as much as 15% or more in volume over the expected temperature range that the engine will encounter. For instance, an engine can fall to relatively low temperatures, possibly below 0° F., when not running in a low temperature environment, and can experience substantially higher temperatures when running for a prolonged period in a relatively warm ambient environment. When an engine is running and for some duration after being shut down, the hydraulic systems for the engine will be substantially completely full of lubricating oil. However, as the engine cools, the lubricating oil in the hydraulic system tends to contract and create fluid voids in such areas as the common rail and/or pump priming reservoir of the hydraulic system. While the formation of these fluid voids is expected and not harmful to the engine or hydraulic system, some undesirable results can occur. For instance, when the engine is restarted after a substantial cooling period, a sometimes annoying excessive cranking of the engine is required in order to bring the hydraulic system back up to full pressure to start the engine anew. While this excessive cranking is not indicative of an actual problem, it can be misperceived as a problem by the engine user.

The present invention is directed to these and other problems associated with replenishing fluid in engine hydraulic systems.

DISCLOSURE OF THE INVENTION

In one aspect, an engine includes a valve cover attached to a head to define a chamber. A replenishing reservoir is fluidly connected to the chamber and a common rail of a hydraulic system via a replenishing conduit. A check valve is positioned in the replenishing conduit.

In another aspect, a method of replenishing oil in a hydraulic system of a engine includes a step of capturing an amount of oil in a replenishing reservoir fluidly connected to a chamber defined by the engine head and valve cover. The replenishing reservoir is fluidly connected to a common rail of a hydraulic system attached when pressure in the common rail is less than pressure in the chamber.

In still another aspect, an oil circulation system for an engine includes a lubricating oil circuit with a circulation passageway. A portion of the circulation passageway is a chamber defined by the engine head and valve cover. A hydraulic system includes a common rail fluidly connected to a plurality of hydraulic devices, a replenishing reservoir fluidly connected to the chamber, and a replenishing conduit extending between the common rail and the replenishing reservoir. A valve is positioned to close the replenishing conduit when fluid pressure in the common rail is substantially greater than fluid pressure in the chamber.

BEST MODE FOR CARRYING OUT THE INVENTION

Figure 1:
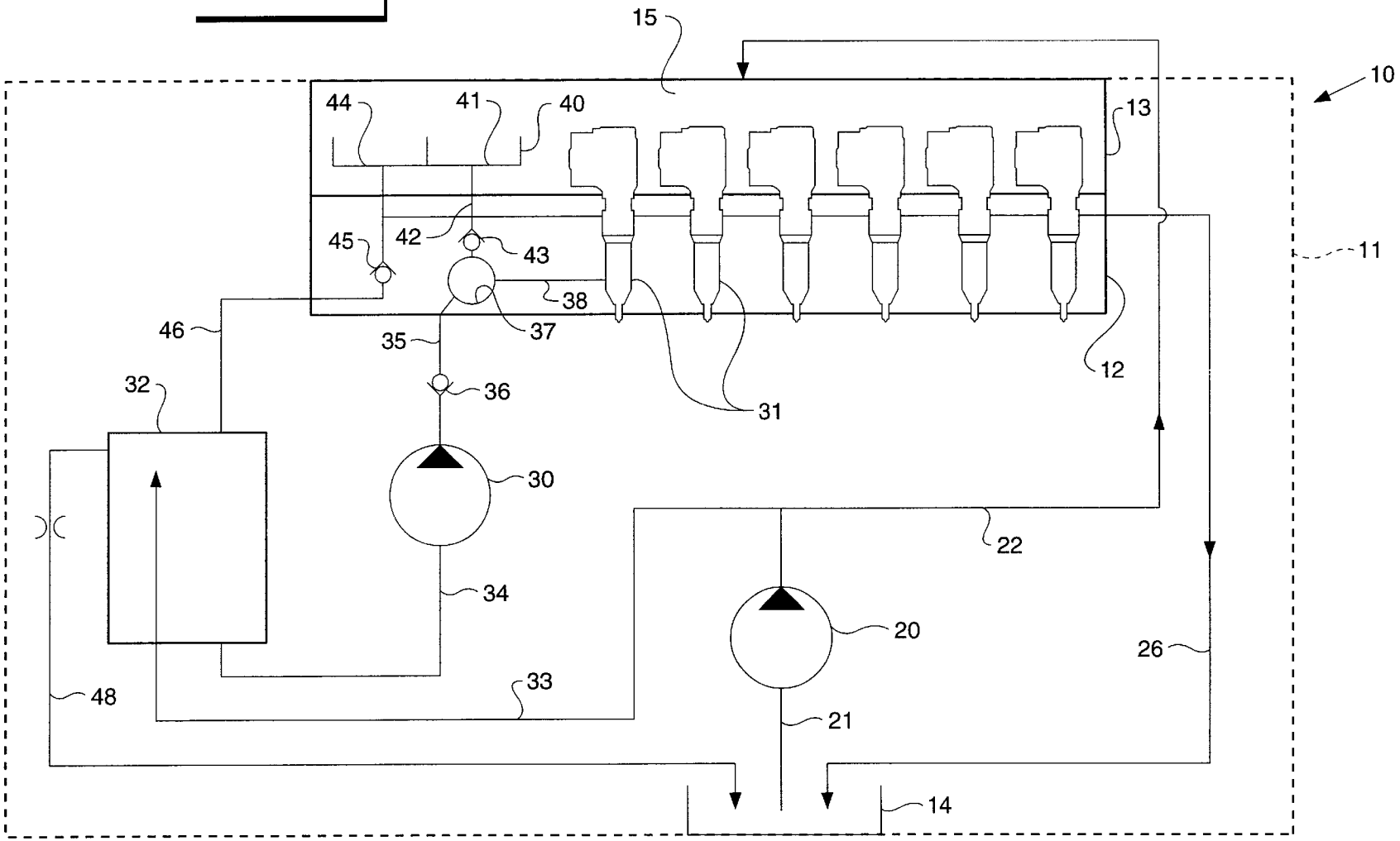
FIG. 1 is a schematic illustration of an engine according to the present invention.

Referring to FIG. 1, an engine 10 provides an engine casing 11 made up of several components attached to one another including a head 12, a valve cover 13, a sump or oil pan 14 attached to a engine block. The engine's lubricating system has a source of lubricating oil such as oil pan 14 and a circulation pump 20 fluidly connected to oil pan 14 via a supply line 21. Circulation pump 20 provides oil to lubricate the various moving parts within the engine through various passageways known in the art. One of these conduits is preferably an engine lubricating circuit 22 that provides lubricating oil to such items as rocker arms and bobbing components positioned in a chamber defined by the head 12 and valve cover 13. After lubricating these various components, the oil returns, usually via gravity, to oil pan 14 via an oil return line 26.

Engine 10 has a hydraulic system, which in the illustrated example is a hydraulically actuated fuel injection system that uses engine lubricating oil as its hydraulic medium. Although the hydraulic system illustrated in FIG. 1 is a fuel injection system, those skilled in the art will appreciate that other hydraulic systems are contemplated, including but not limited to intake and/or exhaust valve actuators, etc. In the illustrated example, a portion of the lubricating oil produced by the engine lubricating oil circulation pump 20 is channeled to a pump priming reservoir 32 via a reservoir supply line 33. A high pressure pump 30 has its inlet fluidly connected to the pump priming reservoir 32 via a pump supply line 34. Those skilled in the art will appreciate that in an alternative, pump supply line 34 might be fluidly connected to oil pan 14, in which case priming reservoir 32 and reservoir supply line 33 could be eliminated. The outlet from high pressure pump 30 is fluidly connected to a common rail 37 via a rail supply line 35. A conventional one way check valve 36 is positioned in rail supply line 35 and insures that no reverse flow of fluid occurs from the rail to the high pressure pump in a conventional manner. A plurality of hydraulically actuated fuel injectors 31 are mounted in head 12 in a conventional manner and fluidly connected individually to common rail 37 via a plurality of branch passages 38, only one of which is shown. After being utilized to actuate the individual fuel injectors 31, the oil is preferably ejected into a chamber 15 defined by the head 12 and valve cover 13. As with the other lubricating oil that finds its way into this chamber, it is channeled back to sump 14 via oil return line 26.

In order to make available oil to replenish both common rail 37 and pump priming reservoir 32, the present invention contemplates a strategy in which a portion of the oil that finds its way into chamber 15 is captured in an oil replenishing reservoir 40. Oil replenishing reservoir 40 is preferably simply a dam or other service feature machine or cast into the service of head 12, but could also be an external reservoir fluidly connected to chamber 15 and located out of outside the same. Thus, those skilled in the art will appreciate that oil replenishing reservoir 40 can take on a wide variety of shapes, and existing engine components can be modified to produce the same or separate components attached to engine 10 could be utilized to make up the replenishing reservoir 40. In the preferred version of the invention, oil replenishing reservoir 40 includes a rail replenishing reservoir 41 and a priming replenishing reservoir 44 that may or may not be fluidly separated by an intervening dam. Rail replenishing reservoir 41 is fluidly connected to common rail 37 via a rail replenishing supply line conduit 42. A simple check valve 43 is preferably positioned in supply conduit 42 and acts as the means by which conduit 42 is opened and closed at appropriate times. In general, check valve 43 remains in a closed position whenever pressure and common rail 37 is substantially higher than fluid pressure in chamber 15, such as when the engine is running, but opens when thermal contraction and common rail 37 and/or gravity forces cause check valve 43 to open, such as when the engine is turned off and cooling. So that the oil replenishing action of the present invention can exploit pressure deferential due to gravity as well as those caused by thermal contraction, rail replenishing reservoir 41 is preferably positioned on the engine at a location at least partially higher than common rail 37.

In this embodiment, the pump priming reservoir 32 also has a means by which its losses due to thermal contraction can be made up. In other words, a portion of oil replenishing reservoir 40 is a priming replenishing reservoir 44 it is fluidly connected to pump priming reservoir 32 via a priming replenishing supply conduit 46. A check valve 45 is positioned in conduit 46 to insure that conduit 46 remains closed while the engine is running, but may open for replenishing purposes when the engine is turned off and cooling, and the oil within priming reservoir 32 begins to contract. In the event that some vapor remains in pump priming reservoir 32 when the engine starts, the gas is pushed and vented back to oil pan 14 via vent return line 48. Like the relationship between the rail replenishing reservoir 41 and common rail 37, the priming replenishing reservoir 44 is preferably positioned at least partially higher than pump priming reservoir 32 so that the replenishing action of the present invention can be assisted by gravity in addition to pressure differentials created by thermal contraction.

Figure 2:
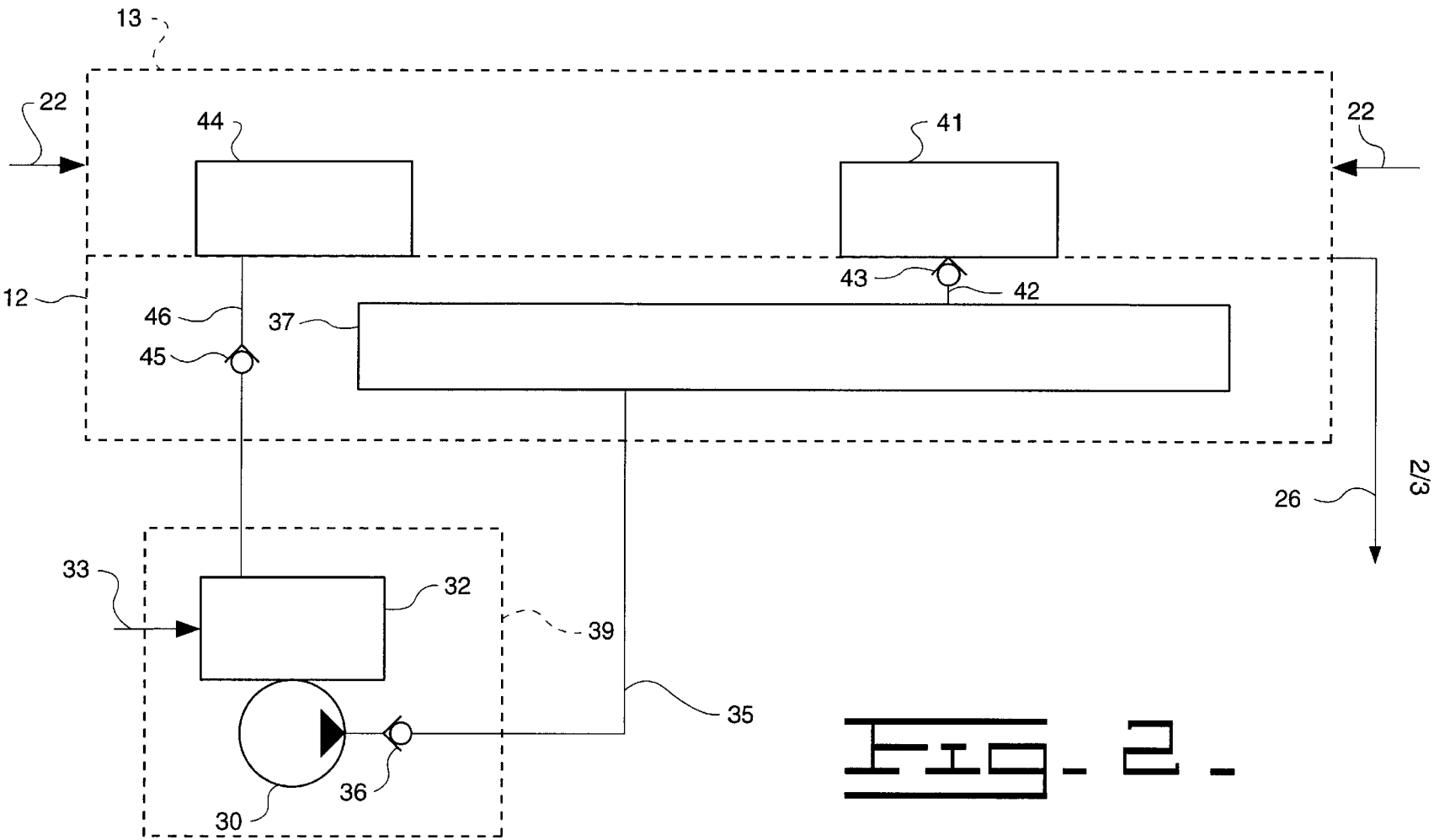
FIG. 2 is a detailed schematic of the replenishing reservoir according to one aspect of the present invention.

Referring to FIG. 2, an enlarged schematic of the replenishing oil replenishing aspect of the present invention is illustrated. In the preferred version of the invention the high pressure pump 30 check valve 36 and pump priming reservoir 32 are all contained within the common high pressure pump housing 39. Also in the preferred version of the present invention, the common rail 37, the rail replenishing reservoir 41 and the replenishing supply conduit 42 are all defined by the engine head 12. For instance, rail replenishing supply conduit 42 is simply a drilling extending between reservoir 41 and common rail 37. This drilling is then partially threaded for the attachment of a conventional ball and seat check valve 43. In addition, priming replenishing supply conduit 46 is also preferably a drilling through engine head 12, but the positioning of this conduit is somewhat dependent upon available locations for mounting high pressure pump housing 39 on the engine. Preferably, replenishing reservoirs 41 and 44 have a volume that is less than about twenty percent of the respective common rail 37 and priming reservoir 32. More typically, these volumes will generally not need to be more than ten or fifteen percent of the relevant common rail or pump priming reservoir in order to have adequate storage volume for replenishment over most temperature ranges.

Figure 3:
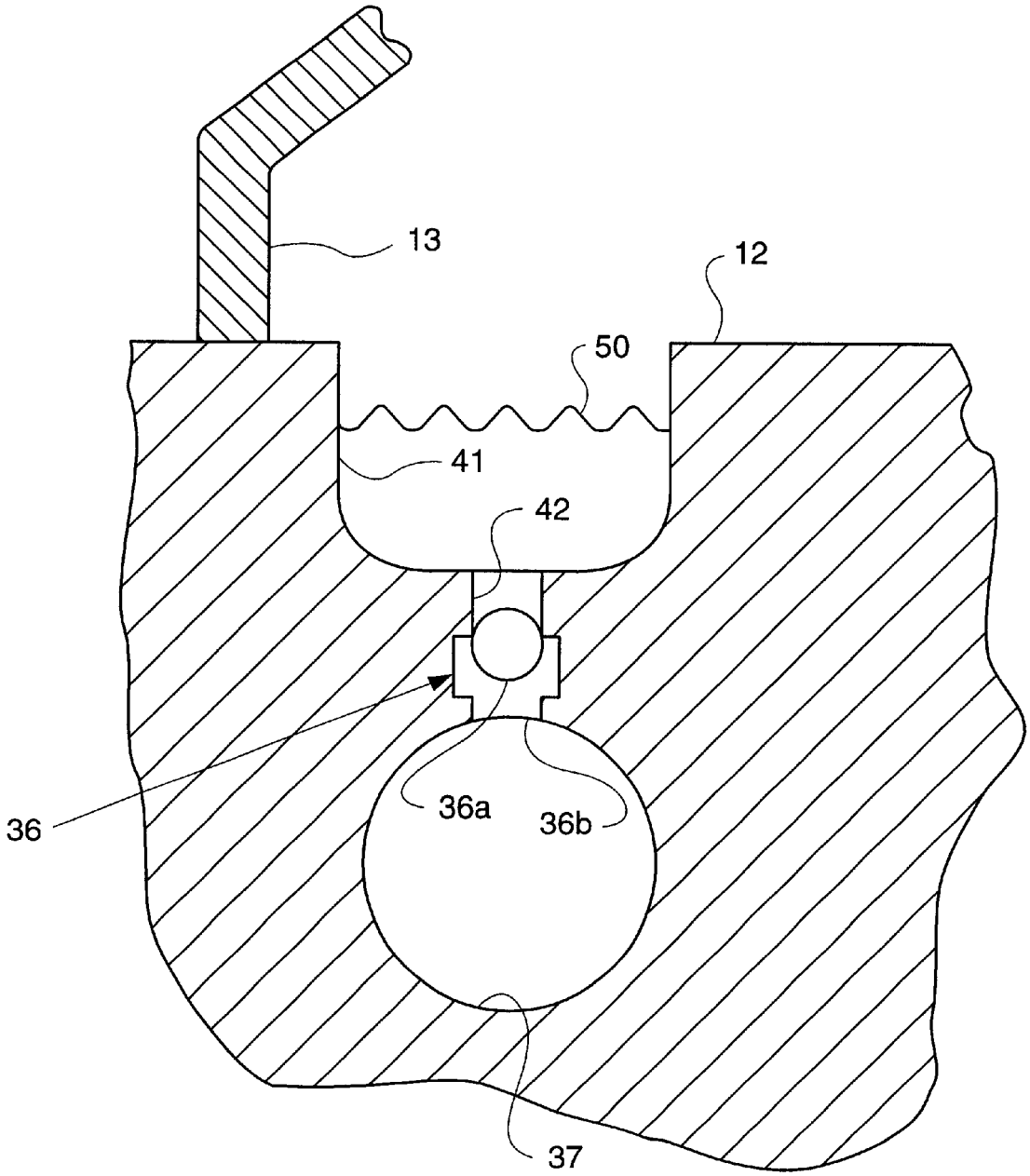
FIG. 3 is a sectioned side view of a portion of an engine in the region of replenishing reservoir according to one aspect of the present invention.

Referring to FIG. 3, a cross section view of valve cover 13 and engine head 12 shows a preferred configuration of the present invention. In other words, head 12 is modified, preferably in the casting stage, to include a depression or other surface features, such as a dam, to act as the rail replenishing reservoir 41. This reservoir is preferably located such that it captures an amount of the oil that finds its way to chamber 15 via rocker arm/valve mechanism lubrication as well as overflow and exhaust from the hydraulically actuated fuel injectors. This surface feature on head 12 is preferably located substantially directly above common rail 37 such that a simple drilling can provide the supply conduit 42. In the preferred version, a simple check valve 36 is attached into conduit 42, such as by threading. The simple check valve 36 preferably includes a ball valve member 36*a* positioned adjacent conical valve seat 36*b*.

INDUSTRIAL APPLICABILITY

The present invention finds potential application in any engine hydraulic system that uses lubricating oil as the hydraulic medium. Such hydraulic systems might include hydraulically actuated fuel injectors, hydraulically actuated exhaust breaks, hydraulically actuated intake and/or exhaust valves, etc. In most such systems, especially in the case of hydraulically actuated fuel injectors, the system often needs to be near full fluid capacity and at full pressure in order for the engine to start. In other words, the fuel injectors will not inject fuel unless they are provided with a source of high pressure actuation fluid (lubricating oil). Thus, the closer to full fluid capacity that the system is when there is an attempt to start the engine, less cranking time will be required and the engine will start faster.

In a typical scenario for the present invention, a portion of the lubricating oil that finds its way into the chamber defined by the valve cover and engine head is captured in the oil replenishing reservoir of the present invention. However, while the engine is running, oil replenishing reservoir 40 is fluidly isolated from the common rail because the relatively high pressure in the rail pushes the check valve to its closed position. Because the anticipated fluid volumes of the oil replenishing reservoirs of the present invention are relatively small, they will tend to fill rather quickly after an engine starts. After the engine has been run for some and then shut down, the replenishing action of the present invention takes place. Not long after the engine is turned off, fluid pressures in the hydraulically actuated fuel injection system decay into equilibrium with ambient pressure. Eventually, the pressure in the common rail 37 will drop sufficiently that the weight of ball valve member 36*a* overcomes the pressure force tending to push it upward and it moves downward to open the replenishing supply conduit 42. At this point, it is likely that the engine is still relatively warm and very little if any fluid transfer has occurred from the replenishing reservoir 40 to the common rail 37. However, as temperatures continue to drop, the oil in the rail tends to contract. When this occurs, pressure in common rail 37 can begin dropping slightly below ambient pressures. As the oil in common rail 37 cools and contracts, new oil from the oil replenishing reservoir 40 is drawn into the common rail 37 both by pressure differentials created by the thermal contraction and by simple gravity effects since the replenishing reservoir 40 is preferably positioned at least partially higher than the common rail 37. Although not preferred, the present invention would still work adequately if the replenishing reservoir 40 was located lower than the common rail 37. In such a case, the pressure differential from the thermal contraction alone would be the means by which the rail 37 was replenished with oil.

In an effort to further reduce cranking times to start a cold engine, the present invention also contemplates an oil replenishing reservoir for the high pressure pump priming reservoir. In order for the engine to start as quickly as possible, the high pressure pump must have available sufficient quantities of oil that it can quickly raise pressure in the common rail. Thus, engineers have observed that the same thermal contraction volume drops in fluid can occur in the priming reservoir for the high pressure pump. Thus, the present invention contemplates capturing a small amount of oil in the same or separate oil replenishing reservoir located in the chamber defined by the valve cover and engine head. This oil replenishing reservoir is fluidly connected to the priming pump reservoir by a conduit that includes a check valve so that the replenishing reservoir is fluidly isolated from the priming pump reservoir when the engine is running and pressures in the priming reservoir are substantially higher than the pressures under the valve cover.

In the preferred versions of the present invention, the oil replenishing reservoir(s) of the present invention is constructed by simply machining or casting an appropriately sized and spaced depression in the engine head. An alternative might be to include another surface feature, such as a dam in order to form the oil replenishing reservoir. Still other alternatives might be to include a separate small container attached to the engine but fluidly connected to the chamber under the valve cover. However, this alternative is less desirable since it would require additional components and fluid passageway connections then would be required with the invention incorporated directly into available space in the engine head. The primary advantages of the preferred version of the present invention lay in its simplicity, its reliability'the fact that the reservoir and its plumbing is concealed, and finally, because the operation of the oil replenishing is passive.

Other aspects, objects, and advantages of the present invention can be obtained from a study of the drawings, the disclosure, and the claims.

What is claimed is:

1. An engine comprising:

an engine casing including a valve cover attached to an engine head and defining a chamber;

a common rail;

a replenishing reservoir being at least partially positioned in said chamber;

a replenishing conduit extending between said common rail and said replenishing reservoir;

a check valve positioned in said replenishing conduit.

2. The engine of claim 1 wherein said replenishing reservoir is located in said chamber at a position at least partially higher than said common rail.

3. The engine of claim 1 wherein said replenishing reservoir is at least partially defined by surface feature cast into said engine head.

4. The engine of claim 1 wherein said engine head defines said common rail and said replenishing conduit.

5. The engine of claim 1 including a pump priming reservoir attached to said engine casing;

a priming replenishing reservoir positioned in said chamber;

a priming replenishing conduit extending between said pump priming reservoir and said priming replenishing reservoir; and a check valve positioned in said priming replenishing conduit.

6. The engine of claim 1 wherein said replenishing reservoir has a fluid volume that is less than 20% of a fluid volume of said common rail.

7. The engine of claim 1 wherein said replenishing reservoir is located at a position at least partially higher than said common rail; and each of said replenishing reservoir, said common rail and said replenishing conduit is at least partially defined by said engine head.

8. A method of replenishing oil in a hydraulic system of an engine, comprising the steps of:

capturing an amount of oil in a replenishing reservoir at least partially positioned in a chamber defined by an engine head and a valve cover; and fluidly connecting the replenishing reservoir to a common rail of a hydraulic system attached to the engine when a pressure in the common rail is less than a pressure in the chamber.

9. The method of claim 8 wherein said capturing step includes a step of casting surface features in the engine head.

10. The method of claim 8 wherein said fluidly connecting step includes a step of positioning a check valve in a replenishing conduit extending between the replenishing reservoir and the common rail.

11. The method of claim 8 including a step of sizing the replenishing reservoir to have a fluid volume that is less than 20% of a fluid volume of the common rail.

12. The method of claim 8 including a step of fluidly connecting the replenishing reservoir to a pump priming reservoir of the hydraulic system when a pressure in the pump priming reservoir is less than a pressure in the chamber.

13. The method of claim 8 including a step of fluidly isolating the replenishing reservoir from the common rail when the engine is running.

14. The method of claim 8 including a step of positioning the replenishing reservoir in the chamber at a location at least partially higher than the common rail.

15. An oil circulation system for an engine comprising:

a lubricating oil circuit that includes a circulation passageway;

a portion of said circulation passageway being a chamber defined by an engine head and a valve cover;

a hydraulic system including a common rail fluidly connected to a plurality of hydraulic devices, a replenishing reservoir at least partially positioned in said chamber, and a replenishing conduit extending between said common rail and said replenishing reservoir;

a valve positioned to close said replenishing conduit when fluid pressure in said common rail is substantially greater than fluid pressure in said chamber.

16. The oil circulation system of claim 15 wherein said replenishing reservoir is located in said chamber at a position at least partially higher than said common rail.

17. The oil circulation system of claim 16 wherein said replenishing reservoir is at least partially defined by surface features cast into said engine head.

18. The oil circulation system of claim 17 wherein said engine head defines at least a portion of said common rail and said replenishing conduit.

19. The oil circulation system of claim 18 wherein said replenishing reservoir has a fluid volume that is less than 20% of a fluid volume of said common rail.

20. The oil circulation system of claim 19 wherein said hydraulic system includes a pump priming reservoir positioned in said chamber, a priming replenishing conduit extending between said pump priming reservoir and a priming replenishing reservoir.

* * * * *